United States Patent [19]

Morrison

[11] Patent Number: 4,607,979

[45] Date of Patent: Aug. 26, 1986

[54] HYDRAULICALLY-POWERED ROCK SPREADER

[76] Inventor: Donald R. Morrison, 6228 Eagle Peak Dr., Charlotte, N.C. 28214

[21] Appl. No.: 685,244

[22] Filed: Dec. 21, 1984

[51] Int. Cl.[4] ..... E01C 19/20

[52] U.S. Cl. ..... 404/110; 404/101; 222/330; 222/414; 239/669; 239/689

[58] Field of Search ..... 404/81, 101, 104–106, 404/108, 110; 222/288, 290, 330, 331, 410, 414; 239/669, 689

[56] References Cited

U.S. PATENT DOCUMENTS

| | | | |
|---|---|---|---|
| 1,040,888 | 10/1912 | Comrie | 404/101 X |
| 1,206,751 | 11/1916 | Clarkson | 404/108 |
| 1,749,805 | 3/1930 | Elliott | 404/108 |
| 2,011,417 | 8/1935 | Robb | 404/106 |
| 2,539,253 | 1/1951 | Jorgensen | 404/110 X |
| 2,989,930 | 6/1961 | Flowers | 404/108 X |
| 3,751,174 | 8/1973 | Layton | 404/108 |
| 4,280,800 | 7/1981 | Bunn | 404/105 X |
| 4,349,294 | 9/1982 | Allen | 404/110 |
| 4,411,554 | 10/1983 | Gratzfeld | 404/110 |

FOREIGN PATENT DOCUMENTS

| | | | |
|---|---|---|---|
| 3101670 | 8/1982 | Fed. Rep. of Germany | 404/108 |
| 2487396 | 1/1982 | France | 404/101 |

*Primary Examiner*—Stephen J. Novosad
*Assistant Examiner*—John F. Letchford
*Attorney, Agent, or Firm*—B. B. Olive

[57] ABSTRACT

A material spreader for spreading large rock over a wet concrete or other surface utilizes a pair of hoppers which are driven back and forth on a bridge support spanning the surface. A gasoline engine mounts above the hoppers and furnishes power for a reversibly-controllable hydraulic hopper drive motor. The rock is dispensed by a rough-surfaced hydraulically motor driven cylinder with the discharge opening being controlled by a pair of spring-loaded gates which position themselves in response to the size rock being spread and the direction of travel of the spreader.

3 Claims, 6 Drawing Figures

HYDRAULICALLY-POWERED ROCK SPREADER

DESCRIPTION

CROSS REFERENCE TO RELATED APPLICATION

The present invention relates to applicant's co-pending application Ser. No. 593,108, filed Mar. 26, 1984, entitled "Hydraulically-Powered Material Spreader".

TECHNICAL FIELD

The present invention relates to material spreaders and more particularly to material spreaders of the type having a pair of bridge-supported hoppers which move back and forth across and above a surface and deposit a layer of material over the surface.

BACKGROUND ART

The prior art includes a variety of types of material spreaders. Conventional lawn fertilizer spreaders include a hopper and a finger agitator rotated by spreader wheels. More closely related to the invention apparatus are material spreaders adapted for use in conjunction with the spreading of rock or other relatively hard and relatively large size particulate material. A number of companies make material spreaders for evenly spreading a layer of topping material on the wet surface of spans of concrete. The conventional spreader mounts one or more hoppers on a bridge which spans the width of the concrete. The hoppers are driven back and forth on the bridge to spread the material. The bridge is mounted on wheels and is manually moved lengthwise of the span after each pass of the hoppers. The hopper drive mechanism for a spreader of this type is typically powered either electrically or pneumatically which requires either power cables or air lines to be fed back and forth across the concrete span being worked. Such arrangements inherently require additional support structure and expense for the added structure, cables and air lines. U.S. Pat. No. 4,349,294 describes one such spreader. Trade literature distributed by K & G Equipment Design, Inc., of Yankton, S.D., describes the "K & G" material spreader, another such spreader. Also, U.S. Pat. No. 4,411,554 describes a spreader having an electric drive and two spaced-apart hoppers on a bridge. In applicant's copending application, Ser. No. 593,108, filed Mar. 26, 1984, entitled "Hydraulically-Powered Material Spreader", there is described a substantially improved material spreader in which the hoppers and spreader box are mounted on a support structure which is driven back and forth along an elevated path by means of gasoline engine powered hydraulic apparatus also mounted on the same support structure. Heat, which accumulates in the hydraulic fluid during operation of the spreader, is dissipated by means of an improved reservoir/hopper-cooling arrangement which allows the heat to be absorbed both by a hopper wall and by the material being spread which significantly contributes to making such system practical.

Experience with the type hydraulically-driven spreader described in applicant's copending application has proven that such spreader is well suited to spreading relatively uniform and relatively small size particles such as sand. However, the spreader taught in applicant's copending application as well as all other spreaders known to applicant have failed to provide a spreader uniquely adapted for spreading large size rock and particularly with a hydraulic drive.

A demand for spreading relatively large and non-uniform size rock, for example of ½" to 2" screen size, has arisen because of the trend toward using exposed aggregate in buildings and also because of the trend in forming patios, sidewalks, and floors with relatively large rock surfaces. Rock surfaces provide an aesthetically attractive appearance and when used as a floor surface can substantially increase the wear life when the rock being spread is chosen to be of an extremely hard type.

The object of the present invention thus becomes that of improving upon applicant's spreader as described in applicant's copending application, Ser. No. 593,108, with regard to providing a spreader more specifically adapted and useful in spreading relatively large and relatively non-uniform rock. This and other objects will become apparent as the description proceeds.

DISCLOSURE OF INVENTION

The present invention provides a spreader especially useful for spreading relatively large and relatively non-uniform size rock, gravel, stone, pebbles, and the like. All such materials are herein referred to for convenience as "rock". A bridge is supported above and spans the width of the area being covered and is fitted with wheels for movement of the spreader lengthwise of the area being covered. A pair of oppositely-disposed hoppers are movably supported on the bridge and store a supply of large rock. The rock is dispensed from the hoppers through a spreader box which joins each of the hoppers and lays down a single, wide, uniform width of rock material on each pass. The hoppers and spreader box are mounted on a support structure which is driven back and forth along an elevated path by means of gasoline engine powered hydraulic apparatus also mounted on the same support structure. Heat, which accumulates in the hydraulic fluid during operation of the spreader, is dissipated by means of a reservoir/hopper-cooling arrangement which allows the heat to be absorbed both by a hopper wall and by the rock material being spread.

Of particular significance to the present invention is the provision on the hoppers of a pair of spring-loaded gates on opposite sides of a metal, hydraulically, motor-powered, rough-surfaced cylinder which rotates in a selected direction coordinated with the direction of travel of the hoppers on the bridge and which on each pass forces the rock out of the hoppers between one of the gates and the cylinder. The gates pivot back and forth according to the size rock passing through between the gate and the cylinder, which may for example be in the ½" to 2" screen size, thus automatically accommodating to the particular size rock being spread and also accommodating to rock jams during which the hydraulic drive stalls without damage until cleared.

BEST MODE FOR CARRYING OUT THE INVENTION

Figure 1:
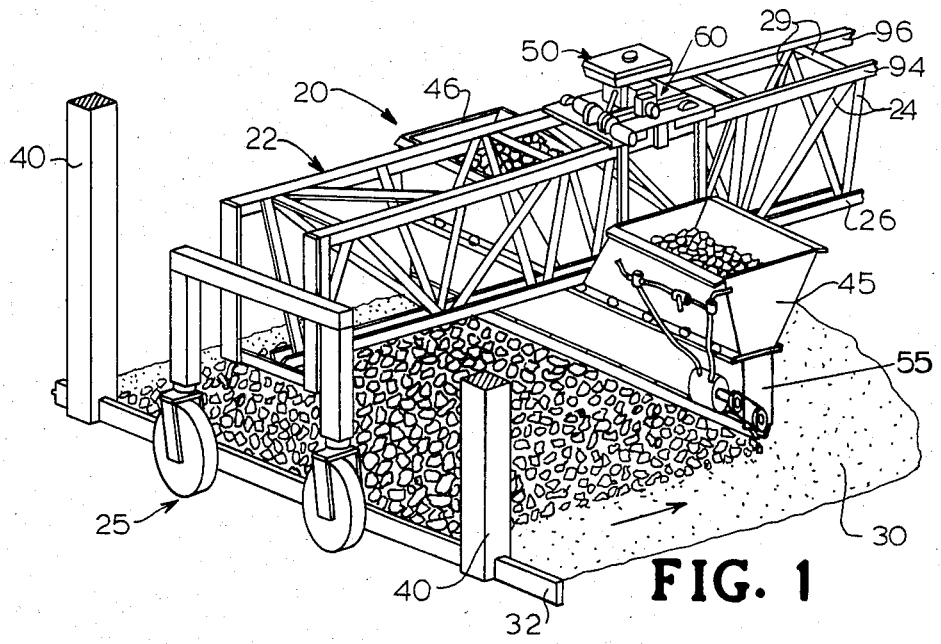
FIG. 1 is a fragmentary pictorial view of the hydraulically-powered large rock spreader of the present invention in use spreading large rock with the rock spreading being depicted as moving from left to right.

Referring initially to FIG. 1, there is illustrated the spreader 20 of the invention fitted with a bridge 22 and sets of wheels 25 on each end of the bridge 22, only one set being shown, for moving bridge 22 lengthwise of a rectangular-shaped span of wet concrete 30 confined by forms 32, only one such form being illustrated. As previously mentioned, spreader 20 may be employed in the typical building operation where large rock are being spread on a floor surface and in other applications may be used for spreading large rock to create exposed aggregrate panels or in other applications may be employed to create large rock surfaces for patio constructions, sidewalks, and the like. Since spreader 20 is expected to be most often used in a building application, there is illustrated in FIG. 1 the typical building columns 40 about which spreader 20 is frequently required to be moved during completion of the large rock spreading process and is mentioned here to emphasize the need for preserving an overall lightweight construction. Accordingly, bridge 22 is formed of a lightweight, open network of interconnected aluminum frame pieces to facilitate movement around columns 40 as well as to facilitate transport from job site to job site. Side pieces 24 are welded or bolted between lower V-member 26 and later referred to upper rail beams 94, 96 located on either side of top pieces 29 to which rail beams 94, 96 are suitably joined.

A pair of open, inwardly-tapered hoppers 45, 46 are suspended on either side of bridge 22 from a support structure. The support structure is driven back and forth lengthwise of bridge 22 by means of a gasoline engine driven hydraulic pump and motor system 50 as later described. Rock spreader 20 of the invention is thus used to spread a uniform, wide, single layer of large rock, or other relatively-large, non-uniform or uniform, hard, particulate material over the span of wet concrete with hoppers 45, 46 being filled with the appropriate large rock or similar material being spread. As hoppers 45, 46 are driven back and forth along bridge 22, spreader 20 is advanced after each pass in one direction so as to provide uniform coverage over the entire surface of the wet concrete span 30 or other surface being covered.

Figure 2:
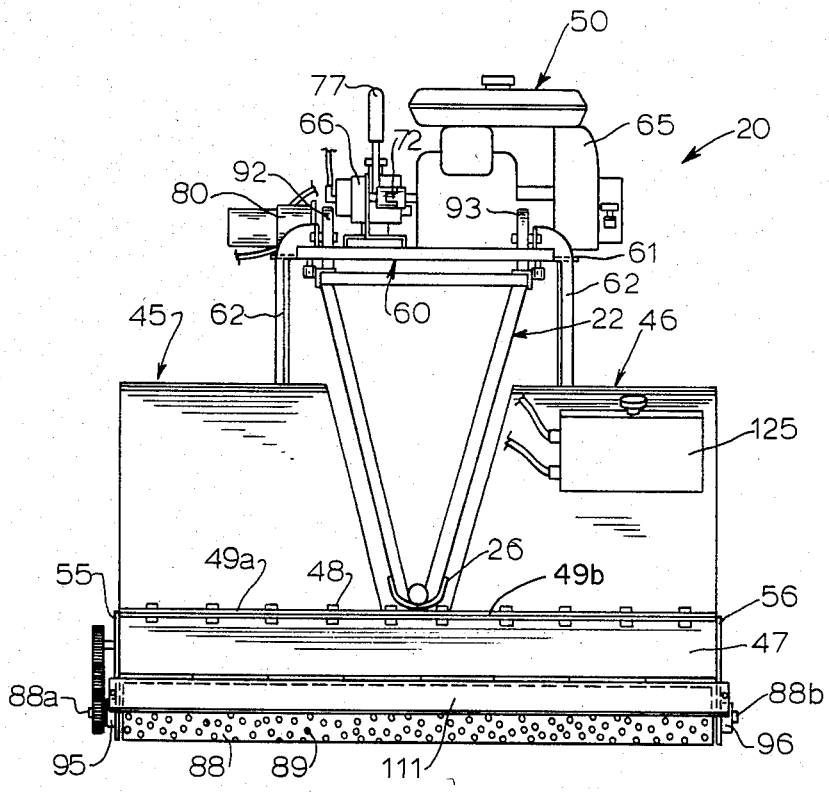
FIG. 2 is an enlarged side elevation view of the side of the spreader opposite that seen in FIG. 1 and with portions of the bridge structure eliminated for clarity of illustration.
Figure 3:
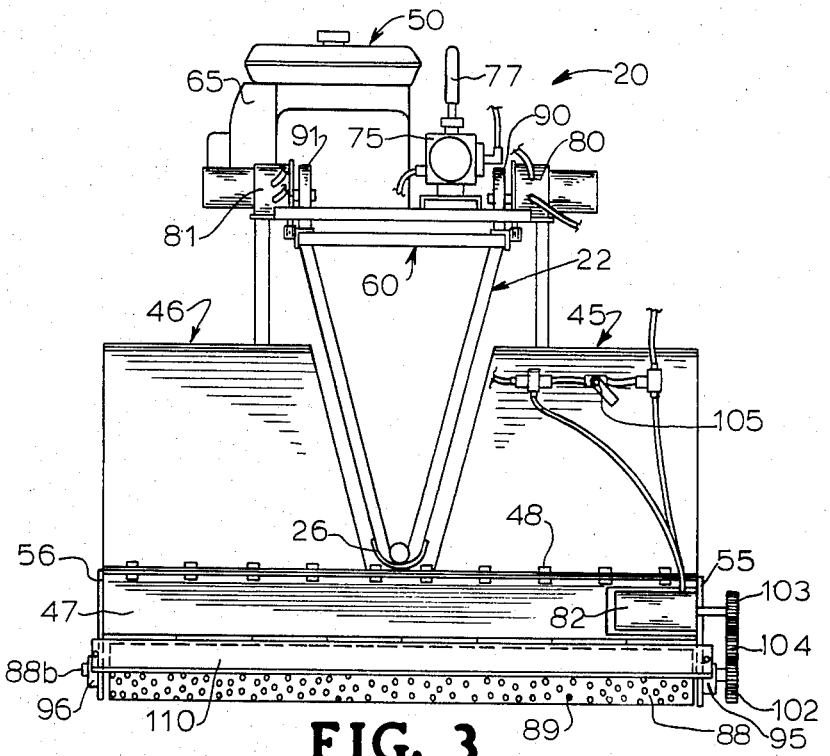
FIG. 3 is an enlarged side elevation view of the spreader opposite to that of FIG. 2.
Figure 4:
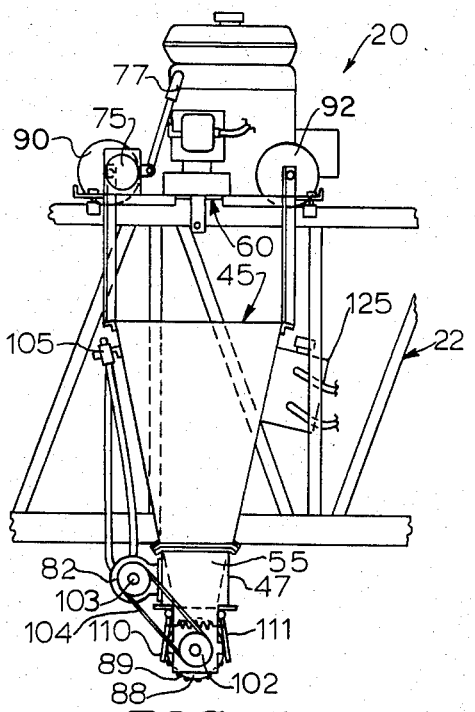
FIG. 4 is an enlarged elevation view of the driven end of the spreader.

Referring next to FIGS. 2–4, hoppers 45, 46 are shown suspended by bars 62 secured to base plate 61 on support structure 60. The previously-mentioned engine hydraulic drive assembly 50 mounts on base member 61 and includes a small gasoline engine 65, e.g., 5 horsepower, a hydraulic pump 66, coupling 72, a hydraulic control valve 75 with a control lever 77 and hydraulic motors 80, 81, 82 with the mentioned components, hydraulic lines interconnected in a conventional manner and as dealt with in more detail in applicant's copending application Ser. No. 593,108.

Gasoline engine 65 drives hydraulic pump 66 through coupling 72. Pump 66 through hydraulic control valve 75 and associated control lever 77 in turn control the operation and direction of rotation of hydraulic motors 80, 81, 82. Hydraulic motors 80, 81 drive wheels 90, 91 which support and power the support structure 60 and cause the hoppers 45, 46 to move back and forth along bridge 22. Wheels 92, 93 provide additional support for support structure 60. Hydraulic motor 82 in turn drives the spreader cylinder 88 (see FIGS. 2–6). Spreader roller 88 comprises a metal cylinder purposely formed with a non-uniform rough surface to facilitate discharge of the large rock or similar material from the hoppers 45, 46. In an actual working embodiment of the invention, metal cylinder 88 was formed with a number of weld dots 89 placed at random along its entire length and over the entire roller surface. The weld dots 89 were approximately ¼ inch high and the random spacing between weld dots 89 varied substantially but was generally in the range of ½ inch to 1 inch apart and provided sufficient friction to effectively grab and eject the large rock. In the event of jamming of either the drive wheels 90, 91, the support structure 60 or the spreader cylinder 88, the hydraulic motors 80, 81 and 82 provide a shock-absorbing clutch-like effect until the fault can be cleared. Wheels 90–93 are mounted on back plate 61 and extend through openings therein (not shown) to facilitate riding on the rails 94, 96.

Hoppers 45, 46 empty into spreader box 47. Spreader cylinder 88 is located in the lower discharge portion of box 47 below the discharge slot S and is driven by gear 102 powered by hydraulic motor 82 through gear 103 and chain 104. Operation and speed of the hydraulic motor 82 is controlled by a manual bypass valve 105 situated on the sidewall of hopper 45 as seen in FIGS. 3 and 4 and direction of rotation is controlled by lever 77 as previously stated. Spreader cylinder 88 in conjunction with its rough surface formed by the previously-mentioned weld dots facilitates agitation, dispensing and movement of the large rock or other similar material placed in the respective hoppers 45, 46 for spreading on the wet concrete surface. The speed of rotation of spreader roller 88 in conjunction with the speed of the support structure 60 substantially controls the speed and volume of material spread. Thus, by manually adjusting valve 105, motor 82 can be completely stopped by bypassing all of the fluid, operated at full speed by stopping all fluid bypass or, by proper adjustment, operated at a less than full speed. It should also be noted that the speed of movement of the support structure 60 back and forth on the bridge 22 can also be controlled by positioning of control valve 75 with lever 77. Thus, the amount of large rock spread per unit area can be controlled and varied within wide limits.

Both of the hoppers 45, 46 and spreader box 47 are preferably made of lightweight metal such as plate aluminum. Using hopper 46 and spreader box 47 as an example, hopper 46 and box 47 are bolted together as indicated at 48 to provide an overall complete hopper with the tops open as illustrated in FIG. 1 for receiving the large rock or other material to be spread.

Looking more closely at FIGS. 2–6, spreader box 47 mounts to hoppers 45, 46 by means of appropriate flanges 49*a*, 49*b* held securely together by previously-mentioned bolts 48. Spreader box 47 mounts a pair of end plates 55, 56 which in turn mount spreader cylinder 88. Cylinder 88 is provided with stub shafts 88*a*, 88*b* extending outwardly from the ends of cylinder 88. Stub shaft 88*a* rotatably mounts in bearing 95 on end plate 55 and extends outwardly therefrom. Likewise, stub shaft 88*b* rotatably mounts in bearing 96 on end plate 56. The outer end of stub shaft 88*a* mounts gear 102.

Hydraulic motor 82, previously referred to, is adjustably mounted on the side of spreader box 47 adjacent end plate 55. Motor 82 drives gear 103 which in turn drives 102 through drive chain 104.

Figure 5:
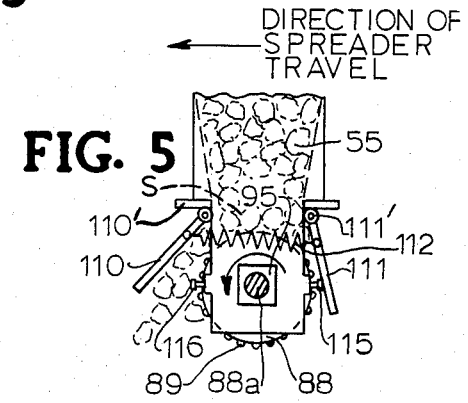
FIG. 5 is an enlarged detailed view of the spreader hopper discharge area illustrating the spreader cylinder turning in a counterclockwise direction discharging large rock from right to left with the spring-loaded gate arrangement of the invention responding accordingly.
Figure 6:
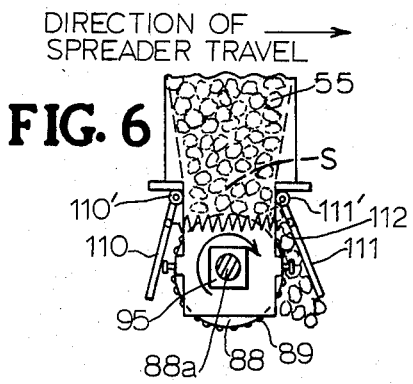
FIG. 6 is a view similar to FIG. 5 but with the spreader cylinder turning in a clockwise direction, spreading rock smaller than that shown in FIG. 4 from left to right with corresponding response of the spring-loaded gate apparatus of the invention.

Of particular significance to the present invention and whose operation is best seen in FIGS. 5 and 6, there is provided a pair of elongated rectangular-shaped gates 110, 111 extending the length of spreader cylinder 88. Gates 110, 111 have hinge-like pivotal mountings 110', 111' along the upper edges thereof and independently pivot on axes on opposite sides of slot S above cylinder 88 as illustrated in the drawings. Gates 110, 111 are connected together at each end by springs 112 which normally cause the gates to be pulled together and toward the outer surface of the spreader cylinder 88. However, as illustrated in FIG. 5, it will be noted that when spreader 20 is moving from right to left and spreader cylinder 88 is rotating in a counterclockwise direction as viewed in FIG. 5, gate 110 will tend to move in and out according to the relatively-large size rock being discharged whereas gate 111 will tend to be moved in and hold its position against its adjustable stop 115. However, when spreader 20 is moving in the opposite left to right direction as illustrated in FIG. 6, it will be noted that gate 110 moves against its adjustable stop 116 whereas gate 111 pivots back and forth according to the smaller size rock being spread by way of example as spreader cylinder 88 rotates in a clockwise direction as further illustrated in FIG. 6. In both directions, the weld spots 89 on cylinder 88 tend to grab and force the rock through the gates.

Hydraulic control valve 75 through manipulation of lever 77, provides means for controlling the direction of flow to hydraulic motors 80, 81 and thus controls the direction in which the wheels 90, 91 move the hoppers 45, 46 and dispenser box 47 back and forth on the rails 94, 96. A hydraulic control of this type is well known and its use in the invention system will be understood by those skilled in the art. In operation, engine 65 is started with control lever 77 in a neutral position allowing the hydraulic fluid to circulate from pump 66 through valve control 75 to reservoir 125 and then back to the pump 66 without flowing through hydraulic motors 80, 81 or 82. In normal operation, hoppers 45, 46 are filled with large rock or other material to be spread and after each pass, one of the operators standing outside the concrete surface and near the end of the pass manipulates control lever 77 so as to reverse the direction in which hydraulic motors 80, 81 are turning so as to thereby reverse the direction wheels 90, 91 move hoppers 45, 46 back and forth on bridge 22. Bypass valve 105 is also adjusted as required for the size of the rock being spread to control the speed of motor 82. As previously explained, the spring-loaded, pivoted gate arrangement, best illustrated in FIGS. 5 and 6, automatically accommodates to the size rock being spread. Thus, there has been provided an extremely practical, large rock dispensing apparatus and shock-absorbing clutch characteristics inherent throughout the system. Additionally, it has been discovered that the large rock flowing through the hopper 45 adjacent reservoir 125 enhances cooling of the hydraulic fluid passed through reservoir 125. Spreader box 47 can be quickly attached or removed thus allowing a more conventional spreader box to be employed when desired with the same hoppers, bridge, and support structure.

What is claimed is:

1. A material spreader for spreading a uniform layer of relatively large size, hard, particulate material such as non-uniform pieces of rock over a lengthwise-extending, wet concrete or other defined surface, said spreader comprising:

(a) a bridge structure supported above and spanning the width of the concrete or other surface over which the rock is being spread and having supporting means adapting said bridge structure to be moved along the length of said surface, said bridge structure providing wheel tracking surfaces on opposite top side surfaces thereof;

(b) a support structure supported by wheels on said bridge structure and movable back and forth along an elevated path on said wheel tracking surfaces provided by said bridge structure;

(c) hopper means comprising a pair of hoppers mounted on opposite sides of said bridge structure and a dispenser box having a top portion integral with the bottoms of said hoppers and a bottom portion providing a dispensing slot, said hoppers being supported from and having open tops located below said support structure for storing material to be spread and dispensing such material through said slot as said hopper means and support structure move back and forth on said bridge structure;

(d) a gasoline engine mounted on said support structure and having a drive shaft powered by said engine;

(e) a hydraulic pump mounted on said support structure and coupled to said drive shaft;

(f) a plurality of hydraulic motors fluidly connected for being driven by pressurized fluid produced by said pump;

(g) a reservoir for storing hydraulic fluid utilized by said pump and motor;

(h) drive means on said support structure for driving said support structure on said bridge structure, said drive means including one or more of said hydraulic motors connected to drive one or more of said wheels;

(i) a dispensing cylinder extending for the length of and mounted below said slot, said dispensing cylinder having a drive connection to another of said motors for driving said dispensing cylinder to assist the flow of material through said slot during operation of said spreader, said dispensing cylinder being formed of metal and having raised spaced apart protuberances on the surface thereof providing an overall roughened surface thereon;

(j) a pair of vertically-disposed substantially flat plate-formed gates extending for the length of said dispensing cylinder on opposite sides therof, said gates being mounted for pivoting outwardly and independently of each other about the upper edges thereof around horizontal axes located above said cylinder and on opposite sides of said slot;

(k) spring means attached to said gates and operative to allow each of said gates to independently pivot outwardly under spring tension when passing said material between said cylinder and a respective said gate in response to the size thereof;

(l) independently adjustable stop means supported on said dispenser box for each of said gates and adapted to limit inward pivoting of each of said gates; and (m) control valve and conduit means including an operator-control member and conduit interconnecting said pump, motors, reservoir and valve means positioned by said control member to allow selective stopping and reversing of the direction of said motors dependent on the position of said control member whereby when said hopper means is driven in one direction on said bridge structure, said dispensing cylinder is driven in a corresponding direction and the gate on the side of said cylinder in the direction of travel of said hopper means is allowed to pivot in and out corresponding to the varying size of material being dispensed and wherein when said hopper means is moved in an opposite direction, said dispensing cylinder is driven in an opposite direction and said opposite gate is allowed to pivot in and out in correspondence with the size material being dispensed with said protuberances on said dispensing cylinder being effective to reduce the tendency of individual pieces of said material to jam between said cylinder and upper portions of said gates.

2. A material spreader as claimed in claim 1 including auxiliary valve means enabling the flow of hydraulic fluid to said motor driving said dispensing cylinder to completely bypass said dispensing cylinder drive motor to stop said dispensing cylinder rotation independent of the driving of said support structure back and forth on said bridge or in the alternative operate at full speed or less than full speed.

3. A material spreader as claimed in claim 1 wherein said dispenser box including said dispensing cylinder and the drive motor therefor and said gates, spring means and adjustable stop means comprise an integral structure detachably secured to the bottoms of said hoppers.

* * * * *